United States Patent [19]

Sanders et al.

[11] Patent Number: 4,826,538

[45] Date of Patent: May 2, 1989

[54] METHOD FOR REMOVING AN INSULATING FLUID (PCB) FROM AN ELECTRICAL INSULATING PART

[75] Inventors: Gerhard Sanders, Olfen; Erwin Wessling, Altenberge, both of Fed. Rep. of Germany

[73] Assignee: BBC Brown, Boveri Aktiengesellschaft, Mannheim, Fed. Rep. of Germany

[21] Appl. No.: 126,737

[22] Filed: Nov. 30, 1987

[30] Foreign Application Priority Data

Nov. 29, 1986 [DE] Fed. Rep. of Germany ..... 3640949

[51] Int. Cl.[4] ..... B08B 3/12

[52] U.S. Cl. ..... 134/1; 134/25.1; 134/32; 134/34; 134/42

[58] Field of Search ..... 134/1, 25.1, 32, 34, 134/42

[56] References Cited

U.S. PATENT DOCUMENTS

| | | | |
|---|---|---|---|
| 2,860,646 | 11/1958 | Zucker | 134/1 |
| 3,001,532 | 9/1961 | Plassmeyer | 134/1 |
| 4,055,507 | 10/1977 | Dastur et al. | 134/1 |
| 4,425,949 | 1/1984 | Rowe | 134/1 |
| 4,483,717 | 11/1984 | Olmsted et al. | 134/1 |
| 4,685,972 | 8/1987 | Fowler | 134/1 |

FOREIGN PATENT DOCUMENTS

| | | | |
|---|---|---|---|
| 1091076 | 8/1956 | Fed. Rep. of Germany | 134/1 |
| 517200 | 5/1973 | U.S.S.R. | 134/1 |
| 608572 | 11/1976 | U.S.S.R. | 134/1 |
| 584912 | 12/1977 | U.S.S.R. | 134/1 |
| 912311 | 3/1982 | U.S.S.R. | 134/1 |
| 2104104 | 3/1983 | United Kingdom | 134/1 |

*Primary Examiner*—Asok Pal

*Attorney, Agent, or Firm*—Herbert L. Lerner; Laurence A. Greenberg

[57] ABSTRACT

A method for removing an insulating fluid containing polychlorinated biphenyl (PCB) which was used as an insulating medium, from the pores of a porous solid electrical insulating part which had been immersed in PCB-containing insulating fluid of an electrical apparatus from the group consisting of electrical transformers, chokes and capacitors includes the steps of removing the insulating part from the electrical apparatus and subsequently immersing the insulating part in a bath containing at least one fluid solvent for PCB selected from the group consisting of aliphatic, aromatic, chlorinated and fluorinated hydrocarbons. The insulating part is moved within the bath for a period of from 8-60 minutes at a speed of from 0.02 to 0.5 meters per second, and the solvent of the bath is heated during the movement of the insulating part from the ambient temperature to a final temperature of from 5° to 25° C. below the boiling temperature of the solvent at the pressure prevailing in the bath. The solvent is subjected to ultrasonic waves having a frequency of from 15 to 40 kHz.

10 Claims, 2 Drawing Sheets

METHOD FOR REMOVING AN INSULATING FLUID (PCB) FROM AN ELECTRICAL INSULATING PART

The invention relates to a method for removing an insulating fluid containing polychlorinated biphenyl (PCB) that was used as an insulating medium, from the pores of a porous solid electrical insulating part, which had been immersed in the insulating fluid of an electrical apparatus from the group consisting of electrical transformers, chokes and capacitors.

Electrical insulating fluids that are formed of or contain polychlorinated biphenyl or PCB were once used frequently in electrical transformers, chokes and capacitors. Insulating fluids containing PCB have generally become known by the name Askarels. These Askarels are mixtures of PCB, trichlorobenzene and tetrachlorobenzene. The insulating fluids mentioned above have good dieletric properties and low flammability, so that fire in electrical apparatus was largely precluded. However, it has been found that these PCB-containing insulating fluids are physiologically and environmentally dangerous, so that the transformers, choke coils and capacitors must be replaced with apparatus that do not contain environmentally harmful insulating fluids. However, replacing these electrical apparatus poses the problem of removing and disposing of the PCB-contaminated devices in a simple manner.

In order to eliminate unusable PCB-containing insulating fluid and PCB-saturated or PCB-moistened solid materials, strict regulations are in effect. For instance, the regulations only permit destruction in an officially authorized incinerator or storage in an officially authorized hazardous waste dump. In order to minimize this expensive type of disposal elimination, it is desirable for the component parts of the electrical apparatus to be cleaned of PCB to such an extent that they have a PCB content of less than 50 ppm and thus no longer fall under the official regulations. While it is hardly difficult to clean metal components of the electrical apparatus, it is more difficult to clean the solid insulating parts of these electrical apparatus. Such insulating substances are formed of insulating paper, insulating pressboard, resin bonded paper, resin bonded fabric, insulating wood, or synthetic-resin-bonded compressed wood. Since the insulating parts are in contact with the insulating fluid in an electrical appliance, the pores of these insulating parts are thoroughly saturated with PCB-containing insulating medium. Rinsing these insulating substances with a solvent for PCB cannot substantially remove the insulating fluid from deep within the insulating parts, instead it can only clean the surface thereof.

It is accordingly an object of the invention to provide a method for removing an insulating fluid from an electrical insulating part, which overcomes the hereinaforementioned disadvantages of the heretofore-known methods of this general type and which permits a simple, cost-effective removal of PCB-containing insulating fluids from the pores of such insulating substances. In particular, the insulating fluid should be removed not only from the regions of the insulating parts that are located close to the surface, but more importantly, the regions of the insulating materials located deep within them should also be cleaned.

With the foregoing and other objects in view there is provided, in accordance with the invention, a method for removing an insulating fluid containing polychlorinated biphenyl (PCB) which was used as an insulating medium, from the pores of a porous solid electrical insulating part which had been immersed in PCB-containing insulating fluid of an electrical apparatus from the group consisting of electrical transformers, chokes and capacitors, which comprises:

removing the insulating part from the electrical apparatus, subsequently immersing the insulating part in a bath containing at least one fluid solvent for PCB selected from the group consisting of aliphatic, aromatic, chlorinated and/or fluorinated hydrocarbons;

moving the insulating part within the bath for a period of from 8–60 minutes at a speed of from 0.02 to 0.5 meters per second, and heating the solvent of the bath during the movement of the insulating part from the ambient temperature to a final temperature of from 5° to 25° C. below the boiling temperature of the solvent at the pressure prevailing in the bath; and subjecting the solvent to ultrasonic wave shaving a frequency of from 15 to 40 kHz.

In accordance with another mode of the invention, there is provided a method which comprises carrying out the step of moving the insulating part within the bath for a period of from 10–30 minutes at a speed of from 0.05 to 0.15 meters per second, carrying out the step of heating the solvent of the bath during the movement of the insulating part from the ambient temperature to a final temperature of from 10° to 20° C. below the boiling temperature of the solvent at the pressure prevailing in the bath, and carrying out the step of subjecting the solvent to ultrasonic waves having a frequency of from 20 to 30 kHz.

As a result of the use of the above-mentioned steps in common, the PCB-containing insulating fluid is removed from all of the pores of the insulating parts, even if the insulating parts have a thickness of from 2 to 4 cm. Since the PCB-containing insulating fluid is removed from the insulating parts to such an extent that the content drops below 50 ppm, further elimination or disposal of these insulating parts is no longer subject to any official regulations. The insulating parts can therefore be eliminated by incineration, and no toxic or harmful exhaust gases are produced.

In accordance with again another mode of the invention, there is provided a method which comprises carrying out the step of heating the solvent in stages.

In accordance with a further mode of the invention, there is provided a method which comprises keeping the solvent at ambient temperature of from 15° to 25° C. in a first operating step, heating the solvent to a medium temperature approximately in the middle between the final temperature and the ambient temperature in an ensuing second operating step, and heating the solvent to the final temperature in a third operating step.

In accordance with an added mode of the invention, there is provided a method which comprises using approximately 10 to 30% of the duration of the heating during the first operating step, using approximately 20 to 35% of the duration of the heating during the second operating step, and using approximately 70 to 35% of the duration of the heating during the third operating step.

With this procedure, the surface and the pores of the insulating part, located near the surface of the insulating part are first cleaned at a low solvent temperature. To this end, all that is necessary are the ambient temperature of approximately 15° to 25° C. and the cleaning time given. In the second operating step, the pores of the insulating part that are located more deeply within the insulating part are cleaned, especially those located at up to approximately one-fourth to one-third the thickness of the insulating part. The third operating step includes the remaining, still more deeply located pores of the insulating part, so that at the end of the total cleaning procedure, the insulating part is free of PCB-containing insulating material, or has at most a proportion of 50 ppm.

In accordance with an additional mode of the invention, there is provided a method which comprises preferably continuously detecting the PCB content of the solvent, and exchanging the solvent for PCB-free solvent if a predetermined threshold value of PCB is exceeded.

In accordance with yet another mode of the invention, there is provided a method which comprises setting a threshold value of 5000 ppm for the PCB content in the first operating step, setting a threshold value of 500 ppm in the second operating step, and setting a threshold value of 30 ppm in the third operating step. In accordance with these steps, the capacity of the solvent for PCB is largely fully utilized, without having to replace the solvent often.

In accordance with yet a further mode of the invention, there is provided a method which comprises circulating the solvent through the bath and at least one heat exchanger.

In accordance with yet an added mode of the invention, there is provided a method which comprises introducing the solvent into the bath below a given fluid level as a fluid stream through at least one nozzle, and aiming the fluid stream at the insulating part. This provides a particularly simple heating and cooling of the solvent. As a result, the insulating fluid that emerges from the pores is removed very rapidly, especially if the solvent is introduced into the bath at a speed of from 0.5 to 1 meter per second. Therefore, in accordance with yet an additional mode of the invention, there is provided a method which comprises introducing the solvent into the bath at a speed of from 0.2 to 1 meter per second and preferably at a speed of from 0.2 to 0.4 meters per second.

In accordance with still another mode of the invention, there is provided a method which comprises moving the insulating part within the bath.

In accordance with still a further mode of the invention, there is provided a method which comprises introducing the insulating part into the bath along with the electrical component that is provided with the insulating part. That is, the electrical coils, capacitor plates or capacitor coils of the electrical apparatus are introduced into the bath and subjected to cleaning along with the insulating parts that are present in these coils or capacitor parts. As a result, not only are the pores of the insulating parts cleaned of PCB-containing insulating fluid, but hairline gaps between the insulating parts and the adjoining coil or capacitor parts are also cleaned of PCB-containing insulating fluid. Additionally, the time-consuming removal of the insulating parts from the coils or capacitor parts also becomes unnecessary.

In accordance with a concomitant mode of the invention, there is provided a method which comprises selecting the solvent in the form of at least one liquid solvent from the group consisting of n-hexane $CH_3—(CH_2)_4—CH_3$; xylene $C_6H_4(CH_3)_2$; tetrachloroethylene $Cl_2C{=}CCl_2$; and trichlorotrifluoroethane $Cl_2FC—CClF_2$.

Other steps which are considered as characteristic for the invention are set forth in the appended claims.

Although the invention is illustrated and described herein as embodied in a method for removing an insulating fluid from an electrical insulating part, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF DRAWINGS

Figure 1:
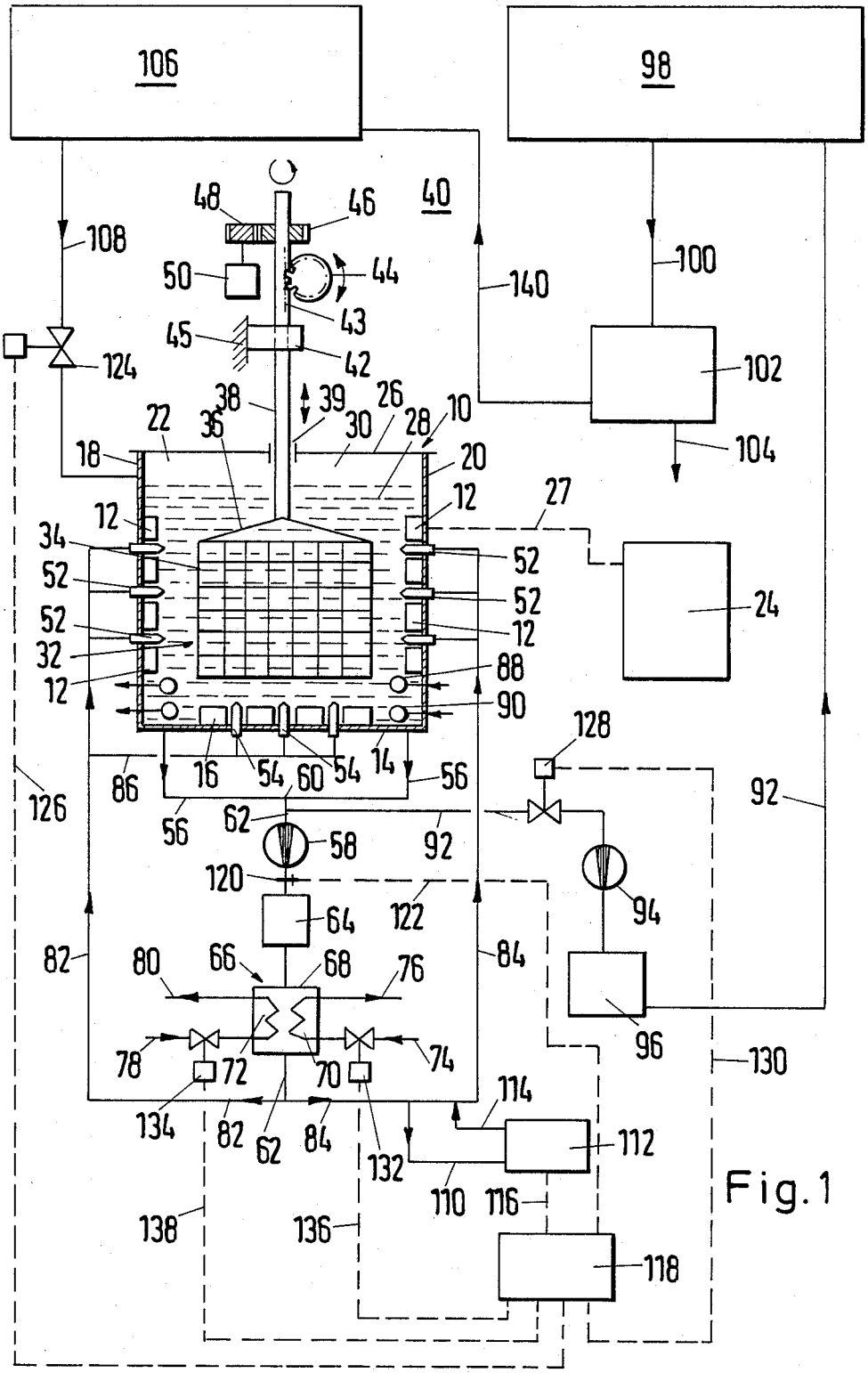
FIG. 1 is a simplified, diagrammatic, vertical-sectional view with a block circuit diagram of a system for performing the method according to the invention.

Referring now to the figures of the drawings in detail and first, particularly, to FIG. 1 thereof, there is seen a system which has a cubic container 10 provided for receiving a solvent. A multiplicity of ultrasonic transducers 12 are disposed on all of the vertical side walls of the container 10. A flat bottom 14 of the container is also provided with a multiplicity of ultrasonic transducers 16. Since the container 10 is shown in a central vertical section in FIG. 1, only a left-hand side wall 18, a right-hand side wall 20, the bottom 14 and a rear wall 22 thereof can be seen. For better clarity, the ultrasonic transducers disposed on the rear wall 22 have not been shown. Each of the ultrasonic transducers 12, 16 is connected to an ultrasonic generator 24 by an electrical line 27. For the sake of clarity, only a single one of the lines 27 has been shown in FIG. 1, although each of the ultrasonic transducers is connected to an ultrasonic generator. The upper closure of the container 10 is provided by a lid 26.

The container 10 contains a fluid chamber 28 for the solvent, as well as an expansion chamber 30 disposed above the chamber 28 which is free of solvent and has a height which is approximately 10 to 20% of the height of the container 10. The fluid chamber 28 serves as a bath for the insulating parts.

A cage 32 which is assembled from individual metal bars 34 is provided in the fluid chamber 28. The dimensions of the intervals between the metal bars are selected in such a way that ultrasonic waves can penetrate the cage without hindrance. The cage 32 is intended to receive the insulating parts that are to be cleaned. The cage 32 is located approximately in the center of the fluid chamber 28 and is spaced apart from the lateral ultrasonic transducers 12 and the lower ultrasonic transducers 16 by approximately equal distances. The open upper end of the cage 32 has a handle 36, which is connected to a vertically extending straight rod 38. The rod 38 extends through an opening 39 in the lid 26 into an outer chamber 40. The rod 38 is guided in a bearing block 42 in the chamber 40, in such a way that the rod can easily be moved in the vertical direction, while a rotational movement is also possible at the same time. The bearing block 42 is, for instance, secured to an element 45 of the building, as is suggested by a diagrammatic illustration in the drawing.

Above the bearing block 42, the rod 38 is provided with teeth 43, which mesh with teeth of a first gear wheel 44 that has a horizontally extended rotational axis. The gear wheel 44 is provided with a non-illustrated drive mechanism. The drive mechanism causes the gear wheel 44 to rotate counterclockwise and clockwise in alternation, the rotational movement constituting only approximately one-fourth to one-half of one complete rotation. In other words, this means that because of the bidirectional rotational movement of the gear wheel 44, the rod 38 and thus the cage 32 are continuously set into up-and-down motion. The rotational movement of the gear wheel 44 is selected in such a way that the cage 32 executes an up-and-down motion at a speed of from 0.02 to 0.5 meters per second, preferably 0.05 to 0.15 meters per second, in the fluid chamber 28.

A further or second gear wheel 46 is disposed on the upper end of the rod 38. The rod is movable in the vertical direction in the hub of the gear wheel 46, so that the location of the gear wheel 46 remains unaffected upon up-and-down movement of the rod 38. However, the connection of the further gear wheel 46 to the rod 38 is formed in such a way that rotational movements of the gear wheel 46 are transmitted to the rod 38. The connection is best achieved by providing the rod 38 with a square cross section in the vicinity of the further gear wheel 46. The square cross section cooperates with a correspondingly shaped cross section of the gear wheel hub.

The further gear whee 46 is driven by a third gear wheel 48, which is disposed on the shaft of an electric motor 50. Both the rpm of the electric motor 50 and the gear ratio of the gear wheels 46, 48 are selected in such a way that the rod 38 and thus the cage 32 are set into rotation by the electric motor, the speed of rotation being selected in such a way that the periphery of the cage 32 executes a circumferential speed of from 0.02 to 0.5 meters per second, preferably 0.05 to 0.15 meters per second.

The ultrasonic transducers 12, 16 are disposed on the walls of the container 10 in such a way that the ultrasound emitted by the ultrasonic transducers strikes the cage 32. Horizontally extending nozzles 52 are provided between the individual lateral ultrasonic transducers 12, while vertically extending nozzles 54 are disposed between the lower ultrasonic transducers 16. The nozzles 52, 54 are introduced from the outside into the fluid chamber 28, where they discharge between the ultrasonic transducers. The outflow direction of the nozzles 52, 54 is aimed at the cage 32.

At least two pipelines 56 that are joined at a point 60 to form a pipeline 62, are provided at an edge of the bottom 14 of the container where no ultrasonic transducers are disposed.

A pump 58, a dirt filter 64 and a heat exchanger 66 are incorporated into the pipeline 62 in that order, beginning at the point 60. The heat exchanger 66 has a housing 68, in which a heating coil 70 and a cooling coil 72 are disposed, so that the solvent flowing therethrough can be selectively heated or cooled. A heating medium, preferably heating water, is supplied to the heating coil 70 through a line 74 and removed through a line 76. A coolant, preferably a coolant liquid such as brine, is supplied through a line 78 and removed through a line 80 after absorbing heat. In many cases it is suitable to provide an electrical heating coil.

After the heat exchanger 66, the pipeline 62 is divided into pipelines 82 and 84. The pipeline 82 leads to the three nozzles 52 of the left side wall 18, while the pipeline 84 leads to the three nozzles 52 of the right side wall 20 of the container 10. For the sake of clarity, the lines that lead to the three nozzles of the rear wall 22 and front wall of the container 10 are not shown in FIG. 1. A further pipeline 86, which leads to the three nozzles 54 of the bottom 14, is also connected to the pipeline 82 that leads to the nozzles 52 of the left side wall 18.

Instead of the external heat exchanger 66, in many cases it may be suitable to provide a cooling coil 88 and a heating coil 90 in the direct vicinity of the bottom of the fluid chamber 28 and to respectively supply the coils with heating medium and coolant through lines that are diagrammatically suggested in the drawing by arrow heads.

A pipeline 92, which leads through a pump 94 and a dirt filter 96 to a first reservoir container 98, is connected to the pipeline 62 at a point upstream of the pump 58, as seen in the flow direction. The first reservoir container 98 is capable of receiving all of the solvent of the fluid chamber 28. The first reservoir container 98 communicates through a pipeline 100 with a preparation system 102, in which the PCB contained in the solvent is filtered out of the solvent and removed through the line 104. Preferably, the PCB removed through the line 104 is sent to be incinerated.

In order to remove the PCB-free solvent from the preparation system 102, a pipeline 140 is provided which discharges into a second reservoir container 106. Finally, the second reservoir container 106 also communicates with the expansion chamber 30 of the container 10 through a pipeline 108. The capacity of the second reservoir container 106 is at least equal to the capacity of the fluid chamber 28.

A sampling line 110 leads from the pipeline 84 to a measuring instrument 112 for PCB. A line 114 also leads back from the measuring instrument 112 to the line 84, where it discharges downstream of the connection point with the sampling line 110.

An electrical line 116 connects the measuring instrument 112 with the input of an electric control unit 118, which controls the operation of the system. An electric temperature sensor 120 is connected to another input of the control unit 118 by means of an electrical line 122. The temperature sensor 120 is disposed between the pump and the dirt filter 64 in the pipeline 62.

An electrically actuated regulating and shutoff device 124 is disposed in the pipeline 108 and is connected to one output of the control unit 118 through an electric line 126. Similarly, an electric regulating and shutoff device 128 is incorporated into the pipeline 92 upstream of the pump 94 and connected with another output of the control unit 118 by means of an electrical line 130. Each of the lines 74 and 78 contains a respective electrical regulating and shutoff device 132, 134, which are connected through respective electrical lines 136 and 138 to outputs of the control unit 118.

The PCB-containing insulating fluid is removed from the electrical apparatus, such as a transformer, choke or capacitor, that has been taken out of operation and is to be disposed of, and the apparatus is rinsed out with a solvent for PCB, which provides superficial cleaning of the apparatus. Then the electrical coils or capacitor parts are disassembled from the electrical apparatus and the porous insulating parts are removed. In order to provide deep-pore cleaning of these insulating parts, the lid 26 is removed from the container 10 and the cage 32 is then moved upward with the aid of the gear wheel 44, until the cage 32 is located above the fluid chamber 28. Then the insulating parts that are to be freed of PCB-containing insulating fluid are introduced into the cage 32. Next, the fluid chamber 28 and the second reservoir container 106 are filled with the solvent for PCB, this solvent being at room temperature and being completely free of PCB. After the cage 32 has been lowered into the solvent bath contained in the fluid chamber 28, the lid 26 is closed, and the gear wheels 44 and 48 are set into motion, so that the cage 32 moves up and down vertically and at the same time executes a rotational movement.

The ultrasonic generators 24 are then switched on, causing the ultrasonic transducers 12, 16 connected to the ultrasonic generators to emit ultrasonic oscillations, which impact upon the insulating parts and the solvent present in the cage 32. The frequency of the ultrasound is preferably from 20 to 30 kHz. The total ultrasonic energy supplied to the ultrasonic transducers by the ultrasonic transducers amounts to from 20 to 80 watts per liter of solvent in the fluid chamber 28, preferably approximately 30 to 40 watts per liter. Since the pump 58 is operating, solvent is removed from the lower region of the fluid chamber 28 through the pipelines 56, freed of dirt particles in the filter 64 and passed through the heat exchanger 66, which initially is not heated or cooled, to the pipelines 82 and 84, which carry the solvent to the nozzles 52 and 54. The solvent flows from the nozzles into the fluid chamber 28 at a speed of from 0.2 to 1 meter per second and strikes the cage 32 and the insulating parts contained therein. This operating step, which takes place with the solvent at ambient temperature, lasts approximately 3 minutes, and a cleaning of the surfaces and those pores of the insulating parts located near the surface is attained, as a consequence of the movement of the cage 32 and the pronounced flow triggered by the nozzles 52, 54, in combination with the exposure to ultrasound.

During this operation, a partial flow of the circulating solvent is drawn out of the pipeline 84 through the sampling line 110, and the PCB content of the solvent is detected in the measuring instrument 112. After the measurement, the solvent is returned to the pipeline 84 through the line 114. If the concentration of the solvent exceeds a value of 5000 ppm at the present operating state, this fact is reported to the control unit 118 through the electrical line 116. The control unit 118 then opens the electrical regulating and shutoff device 128 which was previously closed, with the aid of the electrical line 130. At the same time, an opening command is fed through the electrical line 126 to the previously closed regulating and shutoff device 124. PCB-free solvent then flows out of the second reservoir container 106, through the pipeline 108 and into the fluid chamber 28, while at the same time PCB-containing solvent is removed from the solvent loop through the pipelines 56 and 92. The PCB-containing solvent is delivered through the pump 94 and the dirt filter 96 into the first reservoir container 98. The PCB-containing solvent is delivered from the first reservoir container 98 through the pipeline 100 to the preparation system 102. In the preparation system 102, the PCB is filtered out of the solvent and removed through the line 104, while the PCB-free solvent is transported through the pipeline 140 into the second reservoir container 106. If the content of PCB in the solvent drops below the threshold value which is 5000 ppm in the present case, then this fact is detected by the measuring instrument 112, and the control unit 118 causes the closure of the regulating and shutoff devices 124 and 128, so that no further exchange of solvent takes place.

After the end of the above-described frrst operating step, a switchover is made by the control unit 118 to the second operating step, which proceeds precisely like the first operating step in terms of the movement of the cage 32 and the solvent circulation. Additionally, however, the electrically actuated regulating and shutoff device 132 of the line 74 is opened by the control unit 118, so that the heating coil 70 is subjected to heating medium. The heating medium, preferably heating water, is drawn from a suitable boiler. In this case, the heating of the solvent in the heat exchanger 66 is effected at a temperature between the ambient temperature and the final temperature. An appropriate value for the final temperature is one that is preferably from 10° to 20° C. below the boiling temperature of the solvent. The temperature of the solvent is detected by the temperature sensor 120, and a measurement signal is passed to the control unit 118 through the electrical line 122. The control unit then regulates the flow of heating medium, with the aid of the regulating and shutoff device 132, in such a way that the desired solvent temperature is maintained.

The threshold value of the PCB content of the solvent in the second operating step is approximately 500 ppm. As in the first operating step, if the solvent exceeds that content, PCB-free solvent is carried from the second reservoir container 106 into the fluid chamber 28 and at the same time, PCB-containing solvent is removed from the solvent loop and carried to the first reservoir container 98. In the second operating step, the insulating parts present in the cage 32 are freed from PCB-containing insulating fluid as far as the middle depths thereof.

After the end of the second operating step, which lasts approximately 6 minutes, the control unit 118 switches over to the third operating step. In the third step, the operation of the system proceeds as in operating steps 1 or 2, but with the difference that the third operating step lasts approximately 21 minutes, and the solvent is heated to a final temperature that is approximately 5° C. below the boiling temperature. A value of 30 ppm then serves as the threshold for the solvent PCB content. If this value is exceeded, this is detected by the measuring instrument 112, and the solvent in the fluid chamber is automatically exchanged, as in the first operating step described above.

By heating the solvent in stages and by reducing the maximum permissible threshold value for the PCB content of the solvent in stages, in combination with the exposure to ultrasonic waves, the solvent flow in the fluid chamber 28 and the movement of the insulating parts with the aid of the cage 32, a removal of the PCB-containing insulating material from all of the pores of the insulating parts is attained. The insulating parts are then considered PCB-free and can be disposed of in any desired manner, such as by being used as combustible material for furnaces.

The exposure to ultrasonic waves in the aforementioned frequency range increases the cleaning action of the solvent, so that the PCB-containing insulating fluid is also removed from all of the pores and from all of the hairline gaps. The cleaning action is reinforced by the heating of the solvent in stages and by the exchange of the solvent when a maximum value is attained. The movement of the insulating parts in the solvent with the aid of the cage means that idle spaces are avoided and all of the areas are struck by the ultrasonic waves. The forceful flow around the insulating parts with the aid of the nozzles has the effect of quickly removing the PCB-containing insulating fluid loosened from the pores from the insulating part. The end of the cleaning process occurs whenever the PCB content in the solvent has stopped increasing. It should also be noted that the solvent in the fluid chamber 28 is at ambient pressure. To this end, the expansion chamber 30 communicates with the outer chamber 40 at the point at which the rod 38 is extended through the lid 26.

One of the following fluids is used as a preferred solvent:

1. n-hexane, $CH_3—(CH_2)_4—CH_3$, boiling point 68° C.;
2. xylene, $C_6H_4(CH_3)_2$, boiling point 135° to 145° C.;
3. tetrachloroethylene, $Cl_2C=CCl_2$, boiling point 121° C.;
4. trichlorotrifluoroethane, $Cl_2FC—CClF_2$, boiling point 48° C.

In a very preferred manner, the solvent is formed of one of the fluids listed above in items 1, 2 and 4. The boiling points given are applicable at ambient pressure.

If the boiling temperature of the liquid solvent is above 90° C., then the solvent is heated to a final temperature that is approximately 10° to 25° C. below the boiling temperature. If the boiling temperature of the solvent is below 90° C., then a value that is approximately 5° to 10° C. below the boiling temperature is used as the final temperature for heating the solvent.

In the above-described embodiment, the solvent listed above as item 4 was used. In the first operating step, the solvent temperature was approximately 20° C., in the second operating step approximately 32° C., and in the third operating step approximately 43° C. If necessary, the cleaning can be extended over a total duration of 60 minutes. This is particularly necessary if insulating parts that are thicker than 4 cm are to be cleaned to the depth of the pores thereof.

Rotational movement can be simultaneously imparted to the cage 32 by means of the gear wheels 44 and 48. However, it is also possible to drive only one of the gear wheels 44, 48, so that the cage executes only a reciprocating or a rotational movement.

Should the movement of the solvent in the fluid chamber be overly forceful, then some of the nozzles 52 or 54 can be shut off by means of non-illustrated shutoff devices. The ultrasonic transducers 12, 16 disposed alongside the nozzles each have a circular contour.

In the embodiment illustrated in FIG. 1, the insulating parts are separated from the electrical coils or capacitor components, then introduced into the cage 32 and subjected to cleaning. In many cases, however, it is simpler not to remove the insulating parts from the electrical coils or capacitor parts, but instead to introduce the coils and capacitor parts along with the insulating parts into the fluid chamber 28 of the container 10 and clean them as an entity.

Figure 2:
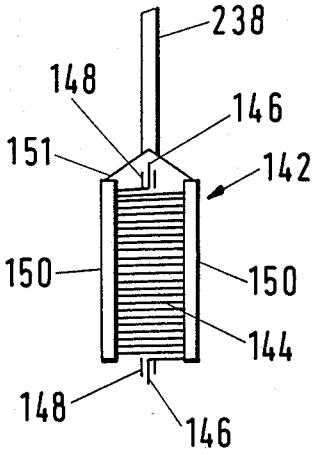
FIG. 2 is a fragmentary side-elevational view of an electrical coil of a transformer or choke.

In FIG. 2, a fragmentary view of an electrical coil 142 is shown. Such coils are used in electrical transformers and electrical chokes and are exposed to the liquid PCB-containing insulating fluid, which is housed along with the coils in a transformer housing or choke housing. The electrical coil 142 has a multiplicity of windings 144 diagrammatically illustrated in the drawings, which may be formed of copper wire. Disposed between the windings 144 are insulating parts which are not shown in FIG. 2, such as insulating or lining paper, resin bonded paper, or resin bonded fabric, and in addition electrical connecting leads 146 of the coil are wound around with insulating or lining paper 148. In order to give the electrical coil 142 good cohesion, insulating parts in the form of bars 150 of insulating wood are provided on the periphery of the windings 144 and the windings 144 are supported thereon. The bars 150 extend over the entire axial length of the coil 142 and have a rectangular cross section. The bars 150 are secured to the windings 144. The cross section of the bars is approximately 10 to 30 $cm^2$.

In order to avoid the expense of removing the PCB-containing insulating fluid from the pores of the insulating parts, that is, from the pores of the insulating paper 148 and the bars 150, the electrical coil 142 is introduced into the fluid chamber 28 of the container 10 for cleaning along with the insulating parts 148, 150. To this end, a rod 238 is secured at an axial upper end of the electrical coil 142 or of the bars 150, with the aid of a holder 151. The rod 238 is identical to the rod 38 of FIG. 1. The rod 238 extends in the axial direction of the coil, as is clearly shown in FIG. 2. The cage 32 and the rod 38 are removed from the system shown in FIG. 1, and instead the electrical coil 142 of FIG. 2 which is provided with the rod 238, is introduced into the fluid chamber 28. In this process the rod 238 is driven by the gear wheels 44 and 46, in just the same manner as the rod 38 was driven in the above-described embodiment of FIG. 1.

The cleaning process then proceeds as described in connection with FIG. 1. The great advantage of this method is that besides a cleaning of the pores of the insulating parts, a cleaning of hairline gaps that are present between individual windings of the coil or between the insulating parts 146, 150 and the windings 144 or connection leads 146, is also attained.

Figure 3:
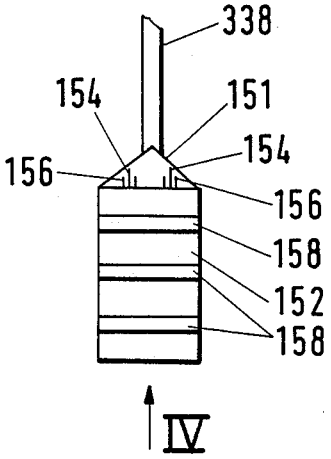
FIG. 3 is a fragmentary side-elevational view of a plate winding of an electrical capacitor.
Figure 4:
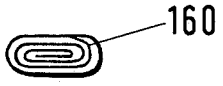
FIG. 4 is a bottom-plan view of FIG. 3, as seen in the direction of an arrow IV.

If the electrical apparatus is an electrical capacitor, then after removal from the capacitor housing, the active portion of the capacitor which contains the insulating fluid is subjected to cleaning in the same manner as described in conjunction with FIG. 2. In FIG. 3, the active portion of an electrical capacitor is shown in a fragmentary view. The active portion includes thin capacitor plates, which are wound into a roll 152 with non-illustrated insulating paper introduced therebetween. Reference is made to FIG. 4 in this connection. The capacitor roll 152 has axially extending electrical connection leads 154, which are surrounded by and insulated with insulating paper 156. Additionally, a plurality of bindings 158 of insulating paper are provided on the periphery of the capacitor roll 152. In FIG. 4, which is a view of the capacitor roll from the direction IV in FIG. 3, it can be seen that the capacitor roll has an approximately elliptical cross section. The individual layers of rolled-up capacitor plates 160 with the insulating paper introduced therebetween are also visible in the drawing.

Figure 5:
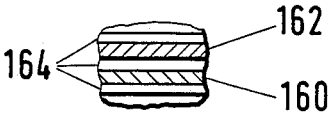
FIG. 5 is a greatly enlarged fragmentary view of a portion of FIG. 4.

FIG. 5 shows a greatly enlarged portion of FIG. 4. As seen in FIG. 5, metal capacitor plates 160, 162 are insulated from one another with insulating paper 164. Since the capacitor plates are thin and therefore are flexible and are in the form of long strips, the capacitor plates are wound along with the insulating paper into a flat capacitor roll 152. The roll is seen in FIG. 4.

In order to be able to clean the capacitor roll 152 together with the insulating parts such as the insulating paper 156, 164 and bindings 158 by removing PCB-containing insulating fluid in the assembled state, as with the electrical coil 142 of FIG. 2, the capacitor roll 152 is provided with an axially extending rod 338, which is constructed exactly like the rod 38 of FIG. 1. The rod 38 is removed from the system shown in FIG. 1 and the capacitor roll 152 along with the rod 338 are instead introduced into the container 10. The gear wheels 44 and 46 then perform the movement and drive of the rod 338, so that the capacitor roll 152 is moved within the fluid chamber 28. The cleaning and exposure of the capacitor roll 152 to ultrasound in the fluid chamber 28 of the container 10 takes place exactly as described in conjunction with FIG. 1. Once again, not only the pores of the insulating parts 156, 158, 164, but additionally the hairline gaps that are present between the insulating paper and the capacitor plates or electrical connections are also freed of PCB-containing insulating fluid. The same applies to the hairline gaps between the bindings 158 and the outer periphery of the capacitor roll 152.

In the present case as well, removal of the PCB-containing insulating fluid from the capacitor roll and from the capacitor parts is possible without requiring disassembly. As a result, the cost is lowered substantially. In order to facilitate the entry of the solvent into the interior of the capacitor roll, it is suitable to provided the capacitor roll with a great number of bores extending across the longitudinal axis and leading at least as far as the center of the capacitor roll.

The transformers, chokes and capacitors under discussion in the present invention involve apparatus that are used in systems that generate and supply electrical current.

The cooling coil 72 disposed in the heat exchanger 66 or the cooling coil 88 of FIG. 1 is put into operation whenever the temperature of the solvent may rise above the particular working temperature provided. A temperature rise of this kind may be triggered by the ultrasonic energy supplied to the ultrasonic transducers. Furthermore, the cooling coil serves to cool down the solvent to ambient temperature after the end of the cleaning process.

The foregoing is a description corresponding in substance to German Application No. P 36 40 949.9, dated Nov. 29, 1986, the International priority of which is being claimed for the instant application, and which is hereby made part of this application. Any material discrepancies between the foregoing specification and the aforementioned corresponding German application are to be resolved in favor of the latter.

We claim:

1. The method for removing an insulating fluid containing polychlorinated biphenyl (PCB), which had been used as an insulating dielectric medium, from the pores of a porous solid electrical insulating part which had been immersed in the PCB-containing insulating fluid of an electrical apparatus from the group consisting of electrical transformers, chokes and capacitors, which comprises the steps of:

(a) removing the insulating part from the electrical apparatus;

(b) immersing the insulating part in a bath containing at least one fluid solvant for PCB selected from the group consisting of aliphatic, aromatic, chlorinated and fluorinated hydrocarbons;

(c) moving the insulating part within the bath for a period of from 8 to 60 minutes at a speed of from 0.02 to 0.5 meters per second;

(d) heating the solvent of the bath during said part immersion period from the ambient temperature to a final temperature of from 5° to 25° C. below the boilding temperature of the solvent at the pressure prevailing in the bath;

(e) subjecting the solvent bath and the immersed insulating part to ultrasonic waves having a frequency of from 15 to 40 KHz.

(f) measuring and monitoring the PCB-content of the solvent in the solvent bath and exchanging the solvent when a predetermined threshold value of PCB is exceeded;

(g) said heating step comprising three operating stages—

(i) a first operating stage wherein said solvent bath is maintained at ambient temperature until the initial PCB threshold value of 5000 ppm of PCB is reached and "such" solvent is excanged for PCB-free solvent;

(ii) a second operating stage wherein the solvent bath is heated to a temperature about midway between the ambient temperature and said final temperature and maintained thereat until a second PCB threshold value of 500 Ppm of PCB is reached and such solvent is exchanged for PCB-free solvent; and (iii) a third operating stage wherein the solvent bath is heated to said final temperature and maintained thereat until the predetermined threshold value of 30 ppm PCB is reached and then such solvent is exchanged for PCB-free solvent.

2. Method according to claim 1, which comprises carrying out the step of moving the insulating part within the bath for a period of from 10–30 minutes at a speed of from 0.05 to 0.15 meters per second, carrying out the step of heating the solvent of the bath during the movement of the insulating part from the ambient temperature to a final temperature of from 10° to 20° C. below the boiling temperature of the solvent at the pressure prevailing in the bath, and carrying out the step of subjecting the solvent to ultrasonic waves having a frequency of from 20 to 30 kHz.

3. Method according to claim 1, which comprises using approximately 10 to 30% of the duration of the heating during the first operating stage, using approximately 20 to 35% of the duration of the heating during the second operating stage, and using approximately 70 to 35% of the duration of the heating during the third operating stage.

4. Method according to claim 1, which comprises carrying out the step of detecting the PCB content of the solvent continuously.

5. The method according to claim 1 which comprises circulating the solvent through the bath and at least one heat exchanger, introducing the circulating solvent into the bath below the fluid level as a fluid stream through at least one nozzle, and directing the fluid stream at the insulating part, wherein said directing nozzles are located on the side walls and/or bottom of the bath and at least one of said nozzles are disposed between the ultrasonic transducers.

6. Method according to claim 5, which comprises introducing the solvent into the bath at a speed of from 0.2 to 1 meter per second.

7. Method according to claim 5, which comprises introducing the solvent into the bath at a speed of from 0.2 to 0.4 meters per second.

8. The method according to claim 1 wherein the insulating part immersed in said solvent bath is moved therethrough in a combined reciprocating and rotational movement.

9. Method according to claim 1, which comprises introducing the insulating part into the bath along with the electrical component that is provided with the insulating part.

10. Method according to claim 1, which comprises selecting the solvent, in the liquid state, from the group consisting of n-hexane $CH_3—(CH_2)_4—CH_3$; xylene $C_6H_4(CH_3)_2$; tetrachloroethylene $Cl_2C{=}CCl_2$; and trichlorotrifluoroethane $Cl_2FC—CClF_2$.

* * * * *